United States Patent [19]

Tanaka et al.

[11] Patent Number: 4,684,766

[45] Date of Patent: Aug. 4, 1987

[54] HIGH VOLTAGE CABLE ASSEMBLY HAVING REDUCED STRAY CAPACITANCE

[75] Inventors: Shigeru Tanaka; Isamu Takagi, both of Ohtawara, Japan

[73] Assignee: Kabushiki Kaisha Toshiba, Kawasaki, Japan

[21] Appl. No.: 778,002

[22] Filed: Sep. 20, 1985

[30] Foreign Application Priority Data

Sep. 25, 1984 [JP] Japan ..... 59-200185

[51] Int. Cl.[4] ..... H01B 7/34

[52] U.S. Cl. ..... 174/115; 174/36; 174/105 SC; 174/107

[58] Field of Search ..... 174/36, 102 SC, 105 SC, 174/107, 115

[56] References Cited

U.S. PATENT DOCUMENTS 2,243,851 6/1941 Booth et al. ..... 174/115
2,446,387 8/1948 Peterson ..... 174/105 SC
3,472,692 10/1969 Isshiki ..... 174/107
4,398,058 8/1983 Gerth et al. ..... 174/36 X

FOREIGN PATENT DOCUMENTS 123143 2/1919 United Kingdom ..... 174/115

*Primary Examiner*—Morris H. Nimmo
*Attorney, Agent, or Firm*—Oblon, Fisher, Spivak, McClelland & Maier

[57] ABSTRACT

A high voltage power cable assembly for applying rectangular high voltage pulses to an X-ray tube of an X-ray diagnostic apparatus, including two conducting lines formed of a plurality of stranded or twisted wires covered with insulating layers, two conductors including a plurality of stranded or twisted wires arranged in opposition to a contact point of the conduct lines, the conductors having opposite ends connected to each other, a semi-conductive layer enclosing the conducting lines and the conductors, an insulating layer covering the semi-conductive layer, a shield layer covering the insulating layer, and a sheath wrapping the shield layer.

7 Claims, 7 Drawing Figures

HIGH VOLTAGE CABLE ASSEMBLY HAVING REDUCED STRAY CAPACITANCE

BACKGROUND OF THE INVENTION

1. Field of the Invention

This invention relates to a high voltage power cable assembly having reduced stray capacitance.

2. Discussion of the Background

The high voltage power cable assembly is used for connection of a high voltage transformer with an X-ray tube in an X-ray diagnostic apparatus. The high voltage transformer provides 60 to 150 kV rectangular pulses to the X-ray tube through the high voltage cable assembly. However, the high voltage power cable assembly has stray capacitance which causes the rise and fall times of the rectangular pulses to be delayed. Especially since the delayed fall time of the rectangular pulses results in increased pulse width, it impedes the high speed scanning of successive pulses.

A conventional high voltage power cable 3 as shown in FIG. 1 is used for the connection of a high voltage transformer with an X-ray tube under regulation of JIS (Japan Industrial Standard) C3407. Such a cable 3 includes two low voltage conducting lines 11A, 11B and high voltage conducting line 14 in the center thereof. The two low voltage conducting lines 11A, 11B are led to a cathode of the X-ray tube and are respectively connected to filament coils for large and small focus spots of the X-ray tube. The high voltage conducting line 14 is also led to the cathode of the X-ray tube and is connected to a common tap of the filament coils. The conducting lines 12A, 12B and 14 include many stranded or twisted wires forming conductors 10A, 10B and 9. The surface of conductors 10A, 10B are covered with an insulating conduit 11A, 11B, such as EP (Ethylene Propylene) rubber. The surface of conductor is covered with a semi-conductive conduit 13, such as semi-conductive EP rubber. This semi-conductive conduit 13 has a smooth surface to increase the insulating voltage rating, and performs in a manner similar to a Faraday shield. JIS permits the omission of this semi-conductive conduit 13. These conducting lines 12A, 12B and 14 are stranded or twisted along the center axis of the cable 3.

The twisted conducting lines 12A, 12B and 14 are covered with a semi-conductive tube 15 to form a cable core 16. This semi-conductive tube 15 increases the insulating voltage rating, in a way similar to Faraday shields.

The cable core 16 is covered with a high voltage insulating layer 17, such as EP rubber. The surface of the high voltage insulating layer 17 is covered with a shield layer 18 including wires such as copper or tin-gilt copper interwoven with fibers such as cotton fibers. The surface of shield layer 18 is covered with a sheath 19, made of, e.g., chloroprene or a vinyl. Each dimension is shown in following Table 1.

TABLE 1

| | Conductors | |
|---|---|---|
| | High voltage | Low voltage |
| Structure (lines/mm) | 19/0.32 | 19/0.32 |
| Diameter (mm) | 1.6 | 1.6 |
| Thickness of semi-conductive rubber (mm) | 0.8 | — |
| Thickness of insulating rubber (mm) | — | 0.8 |

TABLE 1-continued

| | Conductors | |
|---|---|---|
| | High voltage | Low voltage |
| Thickness of semi-conductive tube (mm) | 0.8 | |
| Diameter of core (mm) | 8.5 | |
| Thickness of high voltage insulating layer (mm) | 4.0 | |
| Thickness of shielding layer (mm) | 0.3 | |
| Thickness of sheath (mm) | 1.2 | |
| Total diameter (mm) | 19.5 | |

The stray capacitance Cx of the high voltage power cable 3 is represented by the following equation:

$$Cx = \frac{\epsilon}{2\log\epsilon D/d} \times \frac{1}{9} \ (\mu F/\text{km}) \qquad (1)$$

where $\epsilon$ is the dielectric constant of the insulating layer 17, D is the diameter of the insulating layer 17 and d is a diameter of the cable core 16.

Equation (1) indicates that if the ratio D/d increases, the stray capacitance Cx decrease. However, it is not desirable to increase the diameter D, because it becomes less flexible in a computed tomography apparatus which repeatedly winds or rewinds the cable.

SUMMARY OF THE INVENTION

Accordingly, it is one object of this invention to provide a novel high voltage power cable which effectively eliminates the disadvantages of the conventional cable.

It is another object of this invention to provide a novel high voltage power cable assembly which has reduced stray capacitance.

It is yet another object of this invention to provide a novel high voltage power cable assembly of small diameter.

These and other objects are achieved according to the invention by providing a novel high voltage power cable assembly including two conducting lines having conductors formed plurality of stranded or twisted wires and covered with insulating conduits, two conductors having a plurality of stranded or twisted wires arranged in opposition to a contact point of the conducting lines, the conductors being connected in parallel to common terminals at opposite ends of the conductors, a semi-conductive layer enclosing the conducting lines and the conductors, an insulating layer covering the semi-conductive layer, a shield layer covering the insulating layer, and a sheath wrapping the shield layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
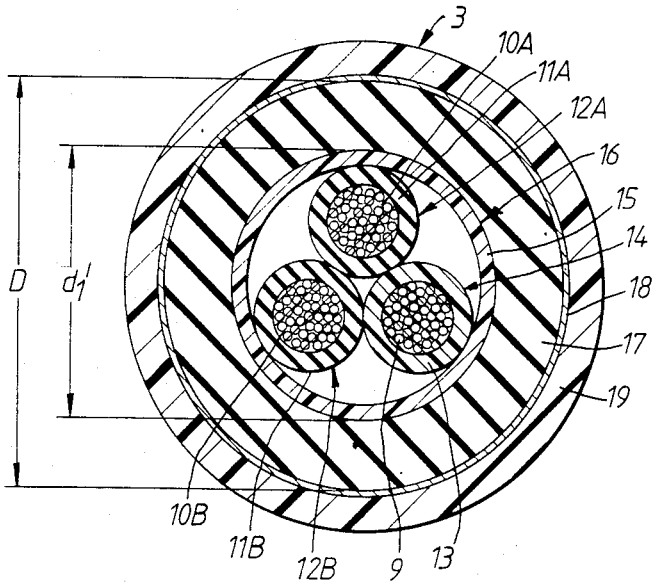
FIG. 1. PRIOR ART
FIG. 1 is a cross-sectional view of a conventional high voltage power cable.

Referring now to the drawings, wherein like reference numerals designate identical or corresponding parts throughout the several views, the principles of the present invention will be explained before describing the structure of the embodiment. In FIG. 2, circles C1, C2 and C3 represent outlines of conductors 12A, 12B of FIG. 1. When these circles C1, C2 and C3 contacts each other, a radius R of a circle C circumscribing the circles C1, C2 and C3 is represented by the following equation:

$$R = r + x$$
$$= r + r/\cos 30^\circ$$
$$= 2.15r$$

where r is the radius of the circles C1, C2 and C3 and x is the distance between center of the circle C and the center of the circle C1.

Therefore diameter $d_1$ of the circle C is about 4.3r.

Figure 3:
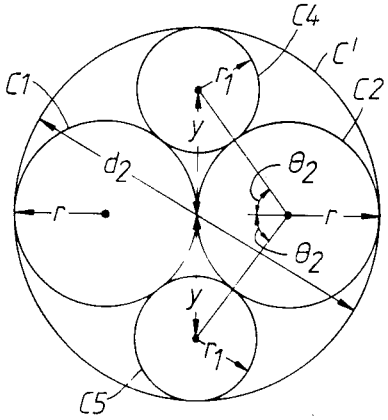
FIG. 3 is a schematic cross-sectional view of a cable core of a high voltage power cable assembly according to the present invention.

In FIG. 3, when the circles C1 and C2 contact each other at the center of a corresponding circumscribing circle C', diameter $d_2$ of the circle C' is smaller than diameter $d_1$ of the circle C. In FIG. 3 two small circles C4, C5 of radius $r_1$ inscribed within the circle C' and the circles C1, C2 can be described. When y is a distance between the center of circle C' and the center of small circle C4, C5 and $\theta_2$ is angle of the line linking both centers of the circles C1 and C2 and the line linking both centers of the small circles C4 and C5, the following relations are given:

$$r/(r+r_1)=\cos\theta_2 \quad (3)$$

$$y+r_1=r_2=d_2 \quad (4)$$

$$(r+r_1)\sin\theta_2=y \quad (5)$$

By eliminating $\theta_2$ and y from above equations (3), (4) and (5), the following equation (6) is derived:

$$r_2=\tfrac{2}{3}\cdot r \quad (6)$$

Figure 2:
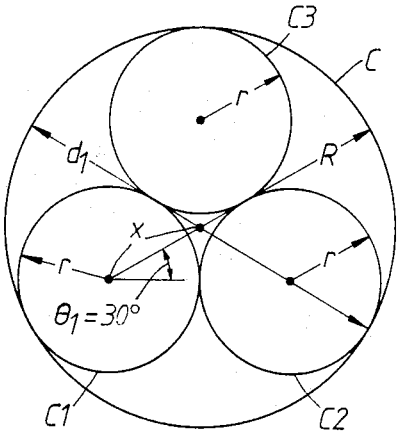
FIG. 2. PRIOR ART
FIG. 2 is a schematic cross-sectional view of a cable core of FIG. 1.

Thus the diameter $d_2(d_2=2r_2)$ of the circle C' becomes smaller than the diameter $d_1$ of the circle C if one of the three conductors 12A, 12B and 14 of FIG. 1 is divided into two conductors which are circumscribed by the circle C', along with the circles C1 and C2 as shown in FIG. 3. Therefore according to equation (1) the stray capacitance of cable as shown in FIG. 3 can be smaller than that of cable as shown in FIGS. 1 and 2.

Now, an embodiment of the present invention will be described with reference to FIG. 4. The two low voltage conducting lines 20A, 20B contact each other at the center axis of the cable assembly 4. These conducting lines 20A, 20B includes 19 stranded or twisted copper wires for conductor 21A, 21B and are covered by insulating conduits 22A, 22B made of e.g., polytetrafluoroethylene sold under the trademark "Teflon". The diameter of conducting lines 20A, 20B is about 1.6 mm. Two bare high voltage conducting lines 24A, 24B each having a diameter 1.1 mm are disposed so that each conducting lines 24A, 24B contacts both the conducting lines 20A, 20B. These conducting lines 24A, 24B include 30 stranded or twisted copper wires for conductors. The opposite ends of these conducting lines 24A, 24B are connected in parallel to the same terminals located at opposite ends of the lines 24A, 24B. In other words current flowing between the terminals is divided into the two conducting lines 24A, 24B.

These conducting lines 20A, 20B and 24A, 24B are twisted along the center axis of the cable assembly 4 or the contact point of conduct lines 20A, 20B. A semi-conductive thin tape 25 is bound around them to form a cable core 26.

This tape 25 reduces non-uniformities in the electrical field in the cable core 26 to increase the insulating voltage of the cable assembly 4.

The surface of the tape 25 is covered with an insulating layer 24, such as an EP rubber, whose thickness is 5.8 mm. The surface of the insulating layer 27 is covered with a shield layer 18 formed of wires such as copper of thin-gilt copper interwoven with fibers, such as cotton fibers. A sheath 19 made of, e.g., chloroprene or vinyl and having a thickness of 1.2 mm surrounds the shield layer 18. The diameter of this cable assembly 4 is about 19.4 mm. Each dimension is shown in the following Table 2.

TABLE 2

| | Conductors | |
|---|---|---|
| | High voltage | Low voltage |
| Structure (lines/mm) | 30/0.18 | 19/0.32 |
| Diameter (mm) | 1.1 | 1.6 |
| Thickness of semi-conductive rubber (mm) | — | — |
| Thickness of insulating rubber (mm) | — | 0.3 |
| Thickness of semi-conductive tube (mm) | 0.2 | |
| Diameter of core (mm) | 4.8 | |
| Thickness of high voltage insulating layer (mm) | 5.8 | |
| Thickness of shielding layer (mm) | 0.3 | |
| Thickness of sheath (mm) | 1.2 | |
| Total diameter (mm) | 19.4 | |

Figure 7:
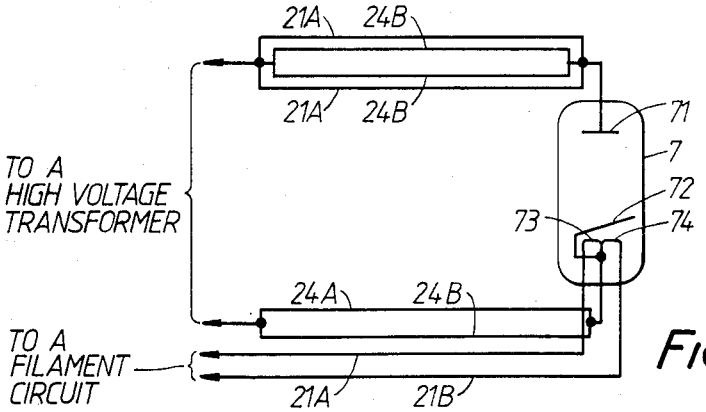
FIG. 7 is a circuit diagram of an X-ray tube circuit.
Figure 5:
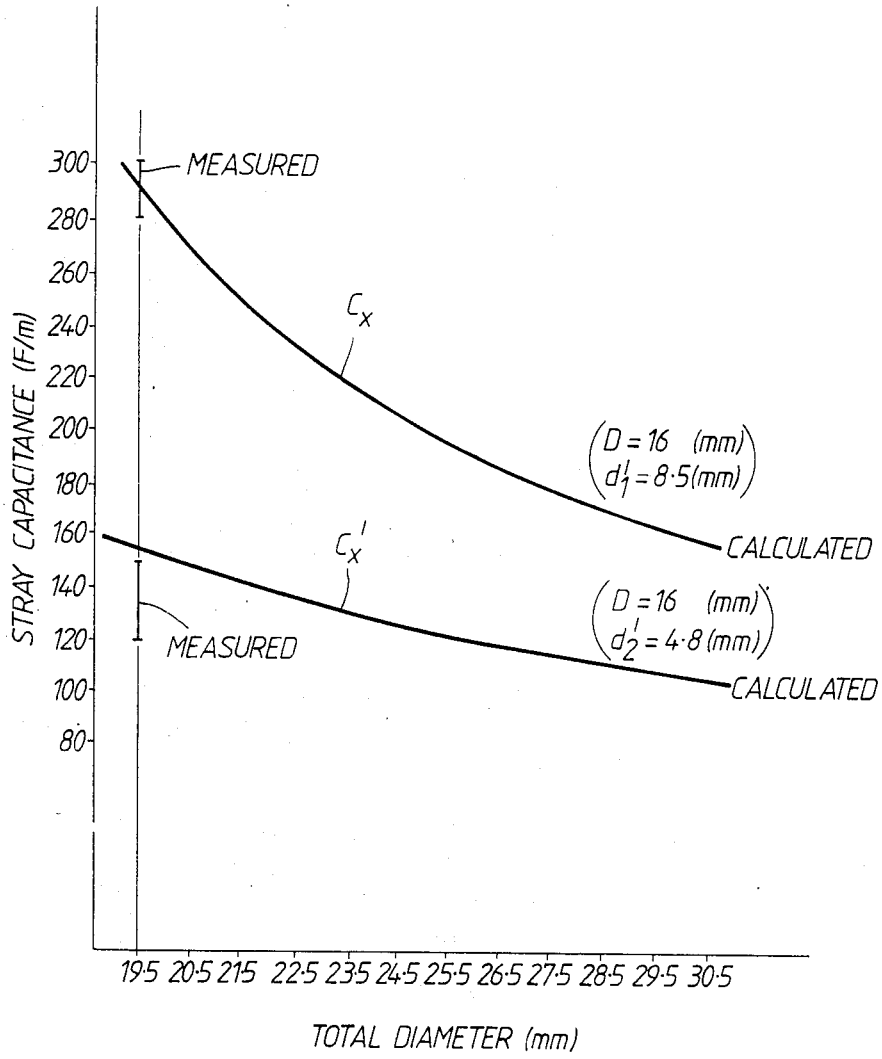
FIG. 5 is a graph illustrating stray capacitance of a high voltage power cable assembly as a function of the total diameter of the cable.

This cable assembly can link three pairs of terminals. In FIG. 7 two conductors 21A, 21B are respectively connected to filament coils 73, 74 for large and small focus spots of a cathode 72 of an X-ray tube 7. The other ends of conductors 21A, 21B are connected to a filament circuit. The two conductors 24A, 24B are connected to a common terminal of the filament coils 73, 74. The other ends of conductors 24A, 24B are connected to one output terminal of a high voltage transformer.

Of course, it is possible to use this cable assembly to link a pair or two pairs of terminals. In FIG. 7, this cable assembly can link an anode 71 of the X-ray tube 7 and the other output terminal of the high voltage transformer. In this case it is preferable to short the conductors 21A, 21B and 24A, 24B at both input and output terminals. It is economical to do so without fabricating a particular cable for the anode.

The cable assembly as defined in Table 2 is capable of operating at an X-ray operating voltage and current of 75 kV and 0 to 2000 mA, respectively. The filament circuit can provide a filament current and voltage of 5A and about 1OV, respectively, to the coils 73, 74.

The diameter $d'_2$ of the cable core 26 of the cable assembly 4 according to the present invention is smaller than that of a conventional cable. Therefore the stray capacitance of the cable assembly of the present invention is smaller according to the equation (1).

Furthermore the thickness of the insulating conduit 22A, 22B and the semi-conductive tape 25 of the cable assembly 4 are thinner than the conventional cable of Table 1. Therefore the diameter of the cable core 26 of the cable assembly 4 is about 4.8 mm thinner than the 8.5 mm diameter of the cable core of Table 1.

The stray capacitance $C_x$ of the conventional cable 3 of Table 1 measures 280 to 300 (pF/m) while the calculated value of this stray capacitance is 290 (pF/m). On the other hand the stray capacitance $C'_x$ of the cable assembly 4 according to the present invention measures 120 to 150 (pF/m) while its calculated value is 153 (pF/m).

In case that the same insulating conduit and semiconductive tube as Table 1 is used, the diameter of the cable core is reduced to 8.0 mm from 8.5 mm if the conductors are arranged as shown in FIG. 3. Since the diameter D of the insulating layer is about 16.5 mm, the stray capacitance is reduced approximately 92% based on the following calculation using the above-noted equation (1):

log(16.5/8.5)/log(16.5/8).

Figure 6:
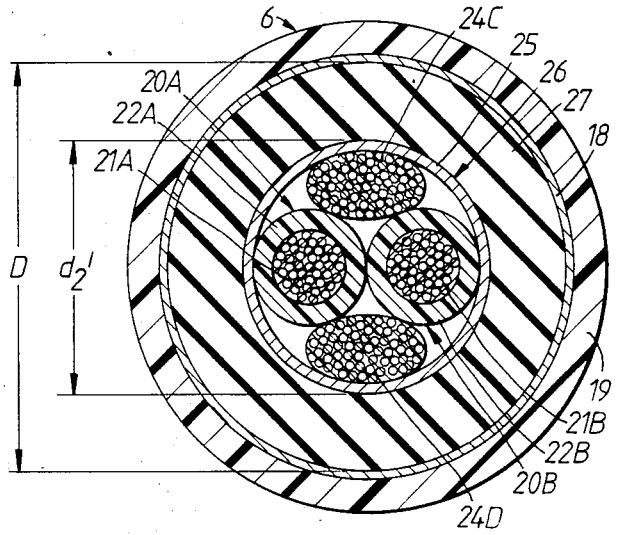
FIG. 6 is a cross-sectional view of another embodiment of the present invention.

Another embodiment according to the present invention is shown in FIG. 6. In this embodiment, the cable assembly 6 is similar to the cable assembly 4 as shown in FIG. 4, except for the two high voltage conductors 24C, 24D.

Figure 4:
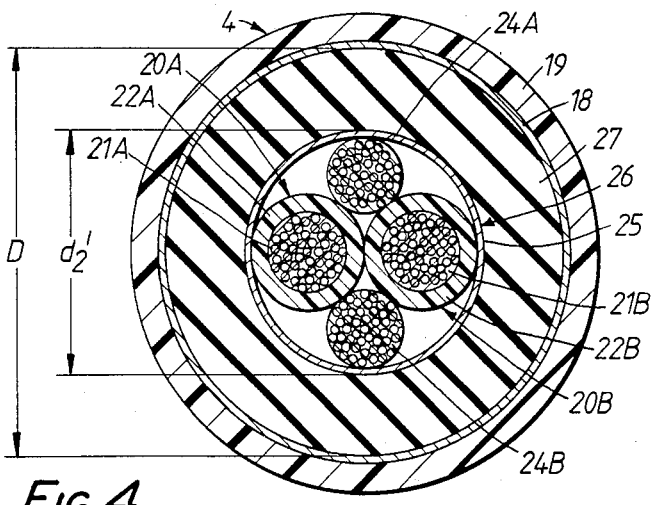
FIG. 4 is a cross-sectional view of a high voltage power cable assembly according to the present invention.

The total area of the cross-sections of conductors 24A, 24B as shown in FIG. 4 is $8/9\ \pi r^2$. It is slightly less than cross-sectional areas of conductors 21A, 21B. In the case of Table 2, since the areas of the conductor 21A and summed conductors 24A and 24B are 8.0 $mm^2$ and 7.6 $mm^2$, the resistance of conductors 24A and 24B increases.

However, in the embodiment as shown in FIG. 6, the cross-sectional areas of conductors 24C, 24D are oval areas which are circumscribed by the tape 25 and conducting lines 20A, 20B. The resistance of the cable 6 can be equal to or less than that of conductors 21A, 21B. The stray capacitance of the cable assembly 6 is the same as that of the cable assembly 4.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high voltage power cable assembly capable of being connected to three or less terminals, comprising:

two conducting lines contacting at a center axis of said cable assembly, said conducting lines including first and second conductors and respective insulating conduits covering said first and second conductors;

third and fourth conductors each contacting with both of said conducting lines and adapted to be connected in parallel to terminals at opposite ends of said third and fourth conductors, said third and fourth conductors having diameters which are less than the diameters of said two conducting lines;

a semi-conductive layer surrounding said two conducting lines and said third and fourth conductors for reducing non-uniformities of electrical fields in said cable assembly;

an insulating layer surrounding said semiconductive layer;

a shielding layer surrounding said insulating layer, said shielding layer including electrical conductive material; and a non-electrically conductive sheath surrounding said shielding layer.

2. The high voltage cable assembly according to claim 1 wherein said conducting lines, said third and fourth conductors and said semi-conductive layer respectively have cross-sections in the form of first and second circles, third and fourth circles, and a fifth circle, said first and second circles contacting each other, said third and fourth circles contacting said first and second circles, said fifth circle circumscribing said first and second circles and said third and fourth circles.

3. The high voltage cable assembly according to claim 1, wherein said conducting lines have cross-sections in the shape of first and second circles, respectively, said third and fourth conductors have cross-sections in the shape of first and second ovals, respectively, and said semi-conductive layer has a cross-section in the shape of a third circle, said first and second circles contacting each other, said first and second ovals contacting said first and second circles, said third circle circumscribing said first and second circles and said first and second ovals.

4. The high voltage power cable assembly according to claim 1, wherein said insulating layer comprises polytetrafluoroethylene.

5. The high voltage power cable assembly according to claim 1, wherein said semi-conductive layer comprises:

a semi-conductive tape wound around said conducting lines and said third and fourth conductors.

6. The high voltage power cable assembly according to claim 3, wherein the sum of the areas of the cross-sections of said third and fourth conductors is equal to the area of the cross-section of one of said first and second conductors.

7. The high voltage power cable assembly according to claim 1, wherein said first through fourth conductors are short circuited together at opposite ends of said conductors and are adapted to be connected to an anode of an X-ray tube.

* * * * *